US005678364A

United States Patent [19]

Shima et al.

[11] Patent Number: 5,678,364

[45] Date of Patent: Oct. 21, 1997

[54] SOUNDPROOF WALL

[75] Inventors: Hiroshi Shima, Kanagawa; Toshiyuki Watanabe, Tokyo, both of Japan

[73] Assignee: Bridgestone Corporation, Tokyo, Japan

[21] Appl. No.: 504,008

[22] Filed: Jul. 19, 1995

[30] Foreign Application Priority Data

Jul. 20, 1994 [JP] Japan ..... 6-189942

[51] Int. Cl.[6] ..... E02D 27/00

[52] U.S. Cl. ..... 52/169.3; 181/210; 52/169.4

[58] Field of Search ..... 52/169.1, 169.3, 52/169.4; 256/13.1, 19, 24; 181/210; 244/114 B

[56] References Cited

U.S. PATENT DOCUMENTS

| | | |
|---|---|---|
| 2,163,809 | 6/1939 | Rauen . |
| 2,646,969 | 7/1953 | Hendrickson . |
| 3,783,968 | 1/1974 | Derry . |
| 4,138,947 | 2/1979 | Pickett . |
| 4,142,468 | 3/1979 | Birnstiel . |
| 4,436,179 | 3/1984 | Yamamoto et al. . |
| 4,558,850 | 12/1985 | Melfi . |

FOREIGN PATENT DOCUMENTS

| | | |
|---|---|---|
| 62-160304 | 7/1987 | Japan . |
| 3-199515 | 8/1991 | Japan . |

OTHER PUBLICATIONS

Journal of Sound and Vibration (1994) 177(3), pp. 289–305, "Acoustic Performance of New Designs of Traffic Noise Barriers": Full Scale Tests by G.R. Watts et al.

Journal of Sound and Vibration (1994) 176(4), PP. 459–473, "The Performance of Multiple Noise Barriers" by D.H. Crombie and D.C. Hothersall.

Journal of Sound and Vibration (1994) 146(2), pp. 303–322, "Efficiency of Single Noise Barriers" by D.C. Hothersall, S.N. Chandler–Wilde and M.N. Hajmirzae.

Applied Acoustics 31 (1990), pp. 77–100, "Mathematical Modeling of Absorbent Highway Noise Barriers" by Sabih I. Hayek.

Applied Acoustics 44 (1995) pp. 353–367, "Multiple–Edge Noise Barriers" by D.H. Crombie, D.C. Hothersall & S.N. Chandler–Wilde.

*Primary Examiner*—Lanna Mai

*Attorney, Agent, or Firm*—Jordan and Hamburg

[57] ABSTRACT

A novel and improved soundproof wall is disclosed comprising a main wall rising from the ground, a first branch wall provided atop the main wall and inclined toward a noise source and a second branch wall provided atop the main wall and inclined away from the noise source. In addition, a subordinate branch wall is provided on at least one of the first and second branch walls and extending in a direction other than that of the branch wall.

3 Claims, 16 Drawing Sheets

SOUNDPROOF WALL

BACKGROUND OF THE INVENTION

The present invention relates to a soundproof wall to attenuate undesired sound or noise coming from roads and highways, railways, factories, etc.

To attenuate noises from roads and highways, railways, factories, etc., soundproof walls are prevalently used to block the noises from coming directly from such noise sources. This is because they are inexpensive and effective as compared with various other soundproof modalities. For a higher effect of sound attenuation, the height of the soundproof walls has to be increased. However, such higher soundproof walls are correspondingly more expensive. Also the higher walls have many disadvantages such as interception of sunlight, obstruction of view (shut-off of prospect), oppressive sensation, ill ventilation, radio-wave jamming, reduced wind resistance, etc.

For a straight wall not capable of effectively attenuating a noise, it has been proposed to use a bent wall 100 of which the upper portion is bent toward the noise source as shown in FIG. 1 or a curved wall 101 having an upper portion curved toward the noise source as shown in FIG. 2. However, such bent and curved soundproof walls cause to arise more serious interception of sunlight, obstruction of view, oppressive sensation, ill ventilation, radio-wave jamming, reduced wind resistance, etc. rather than the straight ones.

Nowadays we have increased traffic everywhere and higher speed vehicles. Thus, the noise pollution has become more and more serious. No counterplan has ever been considered against this tendency. In these situations, straight walls, bent walls or curved walls of 3 meters, 7 meters or 10 meters, for example, in height are used in spite of the above-mentioned disadvantages.

However, such high soundproof walls can only effect sound attenuation corresponding to their height. Generally, an increase by 1 meter of the soundproof wall height results in an additional sound attenuation by about 1 dB as measured at a distance of about 20 meters from the soundproof wall.

To overcome the drawbacks of such conventional soundproof walls, namely, another type of soundproof wall 102 was proposed. As shown in FIG. 3, it has an auxiliary wall producing a "Y-shaped" cross section in order to enhance the effect of sound attenuation without increasing the wall height.

The Y-shaped soundproof wall 102, shown in FIG. 3, was tested concerning the effect of sound attenuation. In this test, the noise from a source 103 was measured at a position 103 as shown in FIG. 4. Also a straight soundproof wall as high as the Y-shaped wall 102 in FIG. 3, was tested. The result of the sound-attenuation test on the wall 102 was compared with that on the straight wall. The comparison result is graphically illustrated in FIG. 5.

However, even such a Y-shaped soundproof wall 102 is unsatisfactory and an improved soundproof wall is needed for a further enhanced effect of sound attenuation.

In the case of the Y-shaped soundproof wall 102, the sound travels along the wall as shown in FIG. 6. FIG. 7 shows sound pressure levels measured at the upper "V" portion of the Y-shaped soundproof wall 102 when a noise generated is in a 250 Hz-octave band, and FIG. 8 shows a distribution of the acoustic intensity of a noise. In FIG. 7, the sound pressures are presented in decibels. In FIG. 8, the directions of arrows indicate those of acoustic energy flows, the longer arrows indicating the larger sound energies.

SUMMARY OF THE PRESENT INVENTION

Accordingly, the present invention has an object to provide a soundproof wall having a greatly enhanced effect of sound attenuation without any increase in height of the wall.

The above object is attained by providing a soundproof wall comprising, according to the present invention, a main wall rising from the ground; a first branch wall provided atop the main wall and inclined toward a noise source; a second branch wall provided atop the main wall and inclined away from the noise source; and a subordinate branch wall provided on at least one of the first and second branch walls and extending in a direction other than that of the branch wall. More than one third branch wall extending in different directions of the first and second branch walls may be provided instead of the subordinate branch wall. In addition, the subordinate branch wall may be provided along with the third branch walls. The first to third branch walls and subordinate branch wall may have a sound absorbing member provided thereon for an enhanced effect of sound attenuation.

According to the present invention, the first branch wall, having the free end thereof extended to the noise source, reflects downward the noise going upward from below and the subordinate branch wall and second and third branch walls attenuate the diffracted sound traveling from the first branch wall to outside the wall. Therefore, it is not necessary to use a tall wall.

These and other objects and advantages of the present invention will be better understood from the ensuing description made, by way of example, of the preferred embodiments of the present invention with reference to the drawings.

DETAILED DESCRIPTION OF THE PREFERRED EMBODIMENTS

Figure 9:
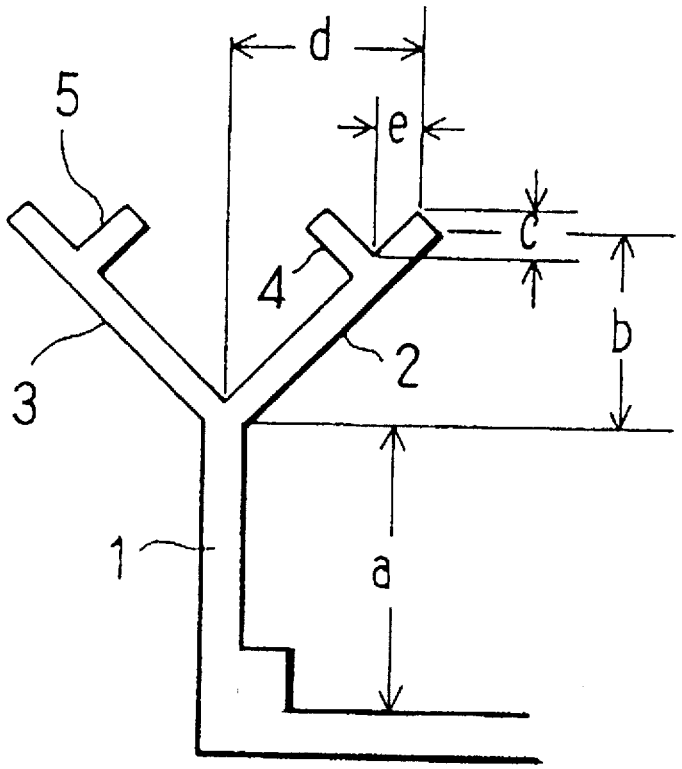
FIG. 9 is a side elevation of a first embodiment of the soundproof wall according to the present invention.

FIG. 9 shows a first embodiment of the soundproof wall according to the present invention. As illustrated, the soundproof wall comprises a main wall 1 rising vertically from the ground. The main wall 1 is branched at the top portion thereof to the right and left to have a first branch wall 2 and second branch wall 3, respectively. The first branch wall 1 is inclined toward a noise source while the second branch wall 3 is inclined away from the noise source. The first and second branch walls 2 and 3 have formed thereon subordinate branch walls 4 and 5, respectively, which extend in directions different from those thereof, respectively. According to this embodiment, the total height of the soundproof wall is 2.5 m. The height a of the main wall 1 from the ground is 1.5 m. the height b of the first and second branch walls 2 and 3 is 1 m. The height c of the subordinate branch walls 4 and 5 from their respective bases on the first and second branch walls 2 and 3 is 0.25 m. The distance d from the center of the main wall 1 to the free ends of the first and second branch walls 2 and 3 is 1 m. The distance e from the bases of the subordinate branch walls 4 and 5 on the first and second branch walls 2 and 3 to the free ends of the first and second branch walls 2 and 3 is 0.25 m.

Figure 10:
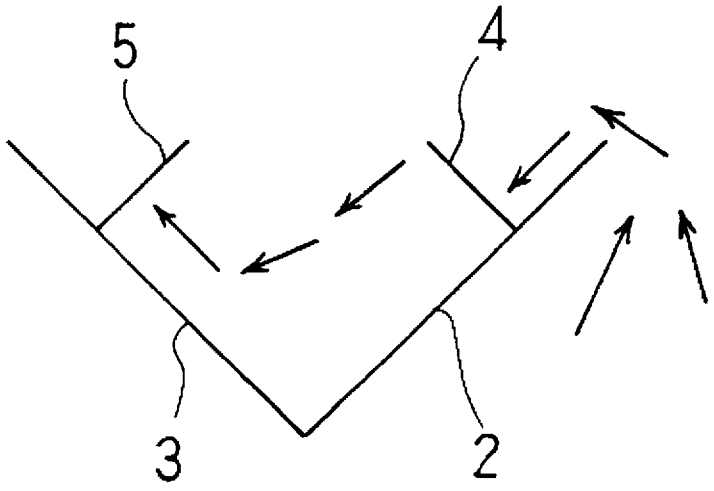
FIG. 10 explains graphically how the sound pressure of a noise is distributed along the soundproof wall according to the present invention.
Figure 11:
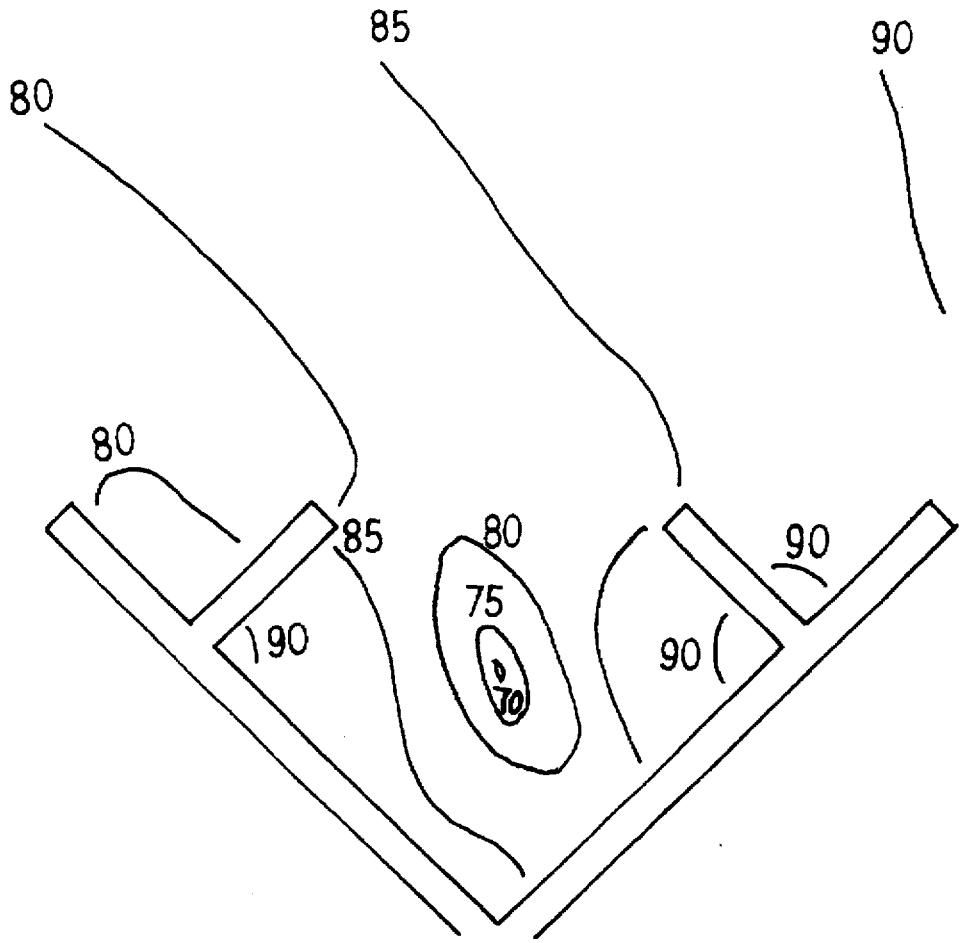
FIG. 11 is a graph showing how the acoustic intensity of a noise is distributed along the soundproof wall according to the present invention.
Figure 12:
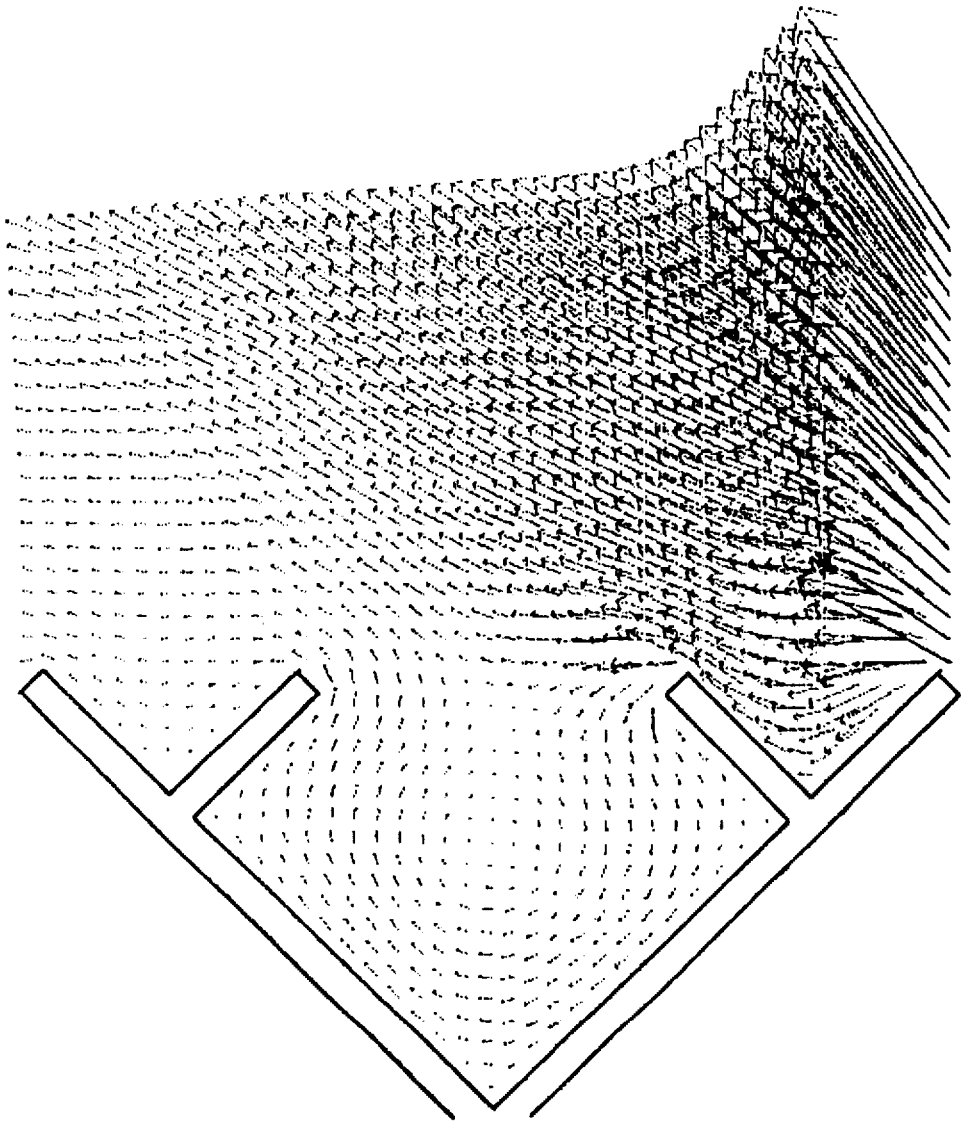
FIG. 12 is a graph showing how the acoustic intensity of a noise is distributed along the soundproof wall according to the present invention.

Referring now to FIG. 10, how the sound travels along the top of the soundproof wall in FIG. 9 will be explained below. The diffracted sound is attenuated by the subordinate branch walls 4 and 5 not provided on the prior-art Y-shaped soundproof wall 102. FIG. 11 above the distribution of the sound pressure of a noise in 250 Hz-octave band on the top of the soundproof wall according to the present invention. FIG. 12 shows the distribution of the acoustic intensity of the noise on the top of the soundproof wall. In FIG. 11, the sound pressures are presented in decibels. In FIG. 12, the directions of arrows indicate those of acoustic energy flows, the longer arrows indicating the larger sound energies.

Figure 13:
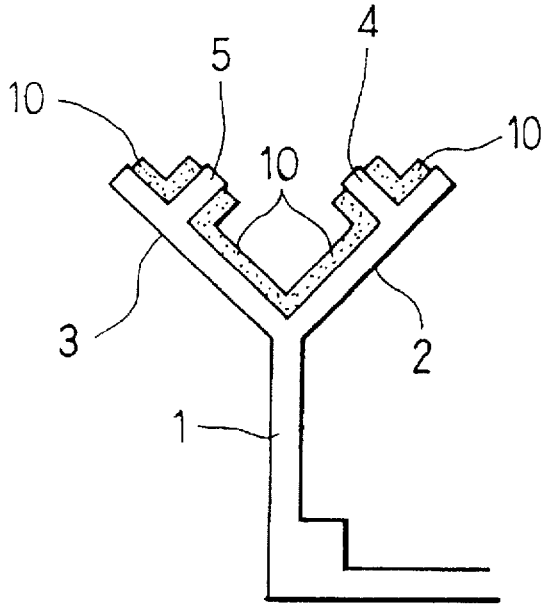
FIG. 13 is a side elevation of a variant of the preferred embodiment of the soundproof wall according to the present invention, having a sound absorbing member almost fully attached on the top thereof.

In the variant shown in FIG. 13, a sound absorbing member 10 is provided on all the upper surfaces of the first and second branch walls 2 and on both surfaces of the subordinate branch walls 4 and 5 and 8 except for their respective end faces. The sound absorbing member 10 may be made of a rock wool, glass wool, ceramic, foamed concrete or the like. The sound absorbing member 10 is secured to each wall surface by means of bolts, pins, adhesive, porous plate, mesh, etc. any of which may be selected according to the material of the sound absorbing member 10.

Figure 14:
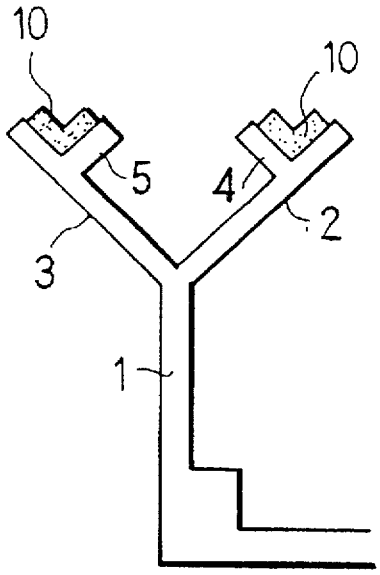
FIG. 14 is a side elevation of another variant of the preferred embodiment, having a sound absorbing member attached on some parts of the top thereof.

In the variant shown in FIG. 14, the sound absorbing member 10 is provided on the upper surfaces of the subordinate branch walls 4 and 5 as well as on those of the portions of the first and second branch walls 2 and 3 that are contiguously extending from the subordinate branch walls 4 and 5, respectively.

Figure 1:
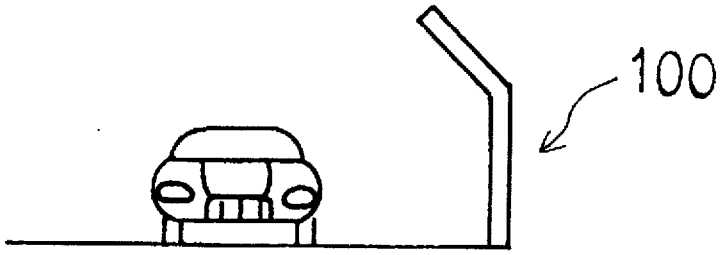
FIG.1 (PRIOR ART)
FIG. 1 is a sectional view of a prior-art soundproof wall used for shut-off of noise from the road.
Figure 2:
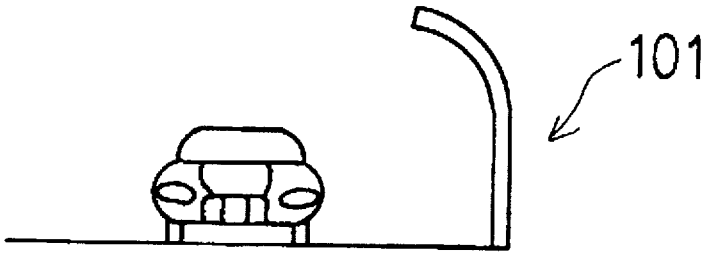
FIG.2 (PRIOR ART)
FIG. 2 is a sectional view of another prior-art soundproof wall used for shut-off of noise from the road.
Figure 3:
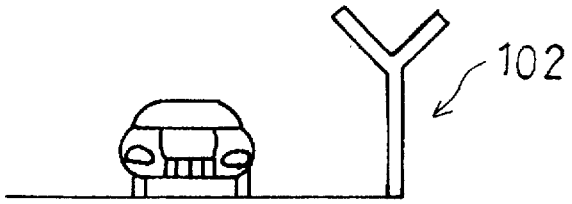
FIG.3 (PRIOR ART)
FIG. 3 is a sectional view of a still another prior-art soundproof wall for shut-off of noise form the road.
Figure 4:
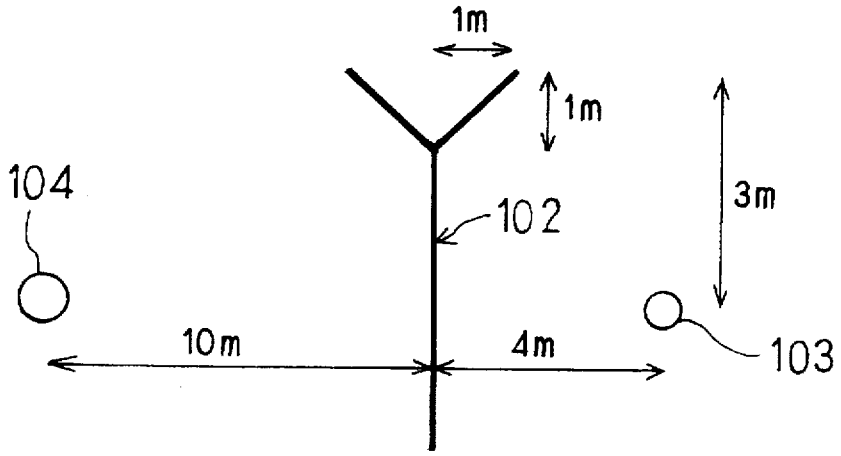
FIG.4 (PRIOR ART)
FIG. 4 explains how the effect of sound attenuation by the Y-shape soundproof wall is measured.
Figure 5:
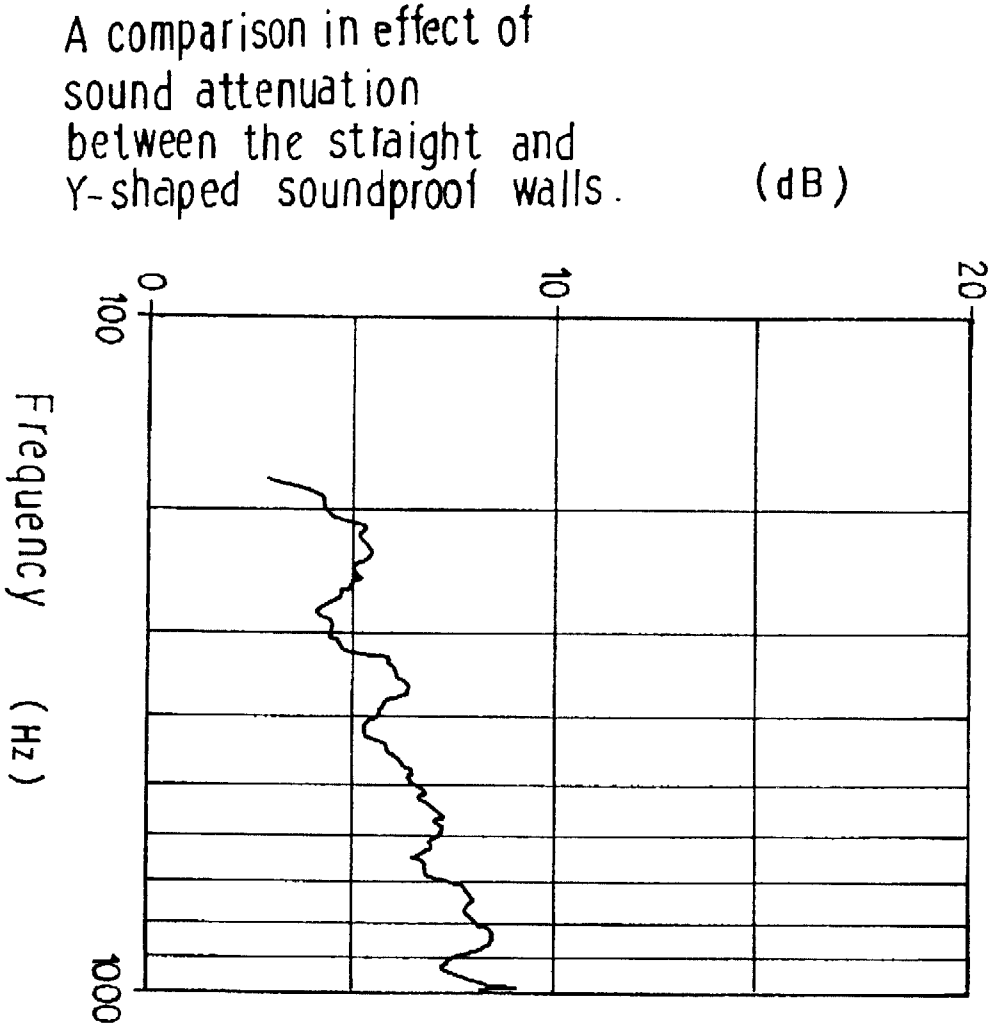
FIG.5 (PRIOR ART)
FIG. 5 is a graph showing a comparison in effect of sound attenuation between the straight and Y-shaped soundproof walls.
Figure 6:
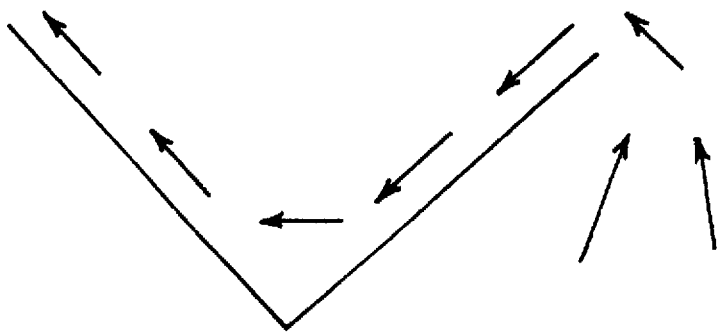
FIG.6 (PRIOR ART)
FIG. 6 shows graphically how the sound travels along the Y-shaped soundproof wall.
Figure 7:
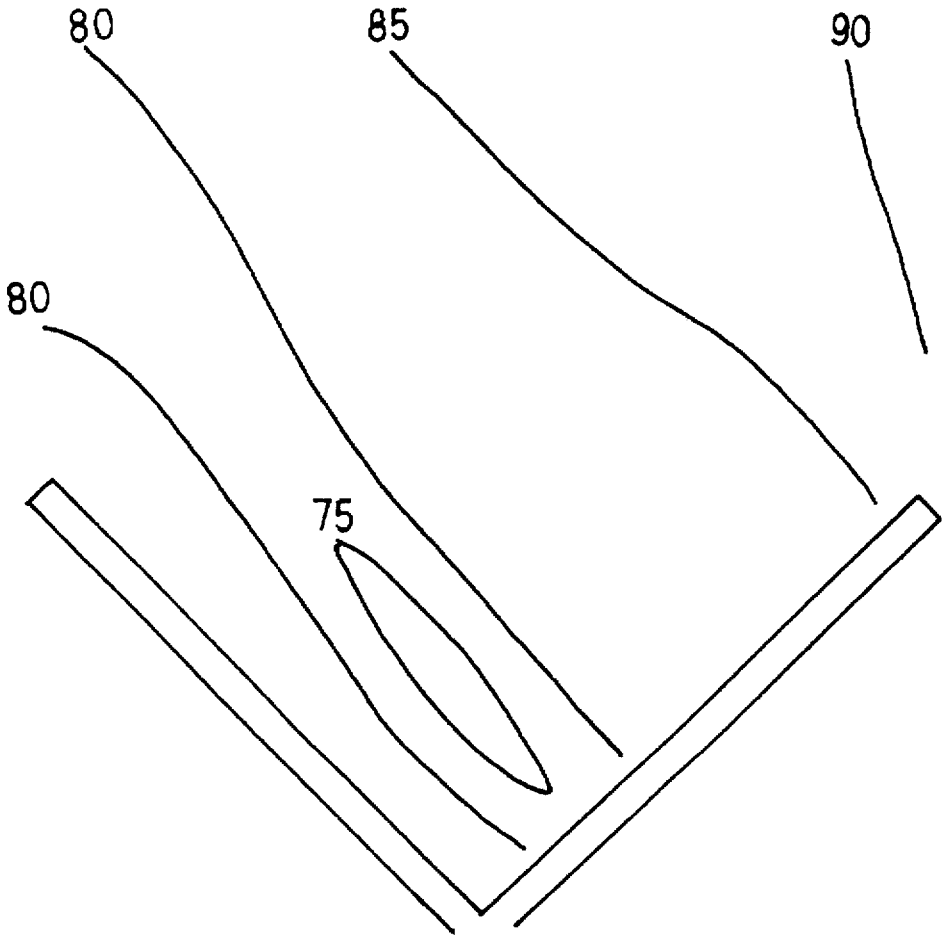
FIG.7 (PRIOR ART)
FIG. 7 is a graph showing how the sound pressure of a noise is distributed along the Y-shaped soundproof wall.
Figure 8:
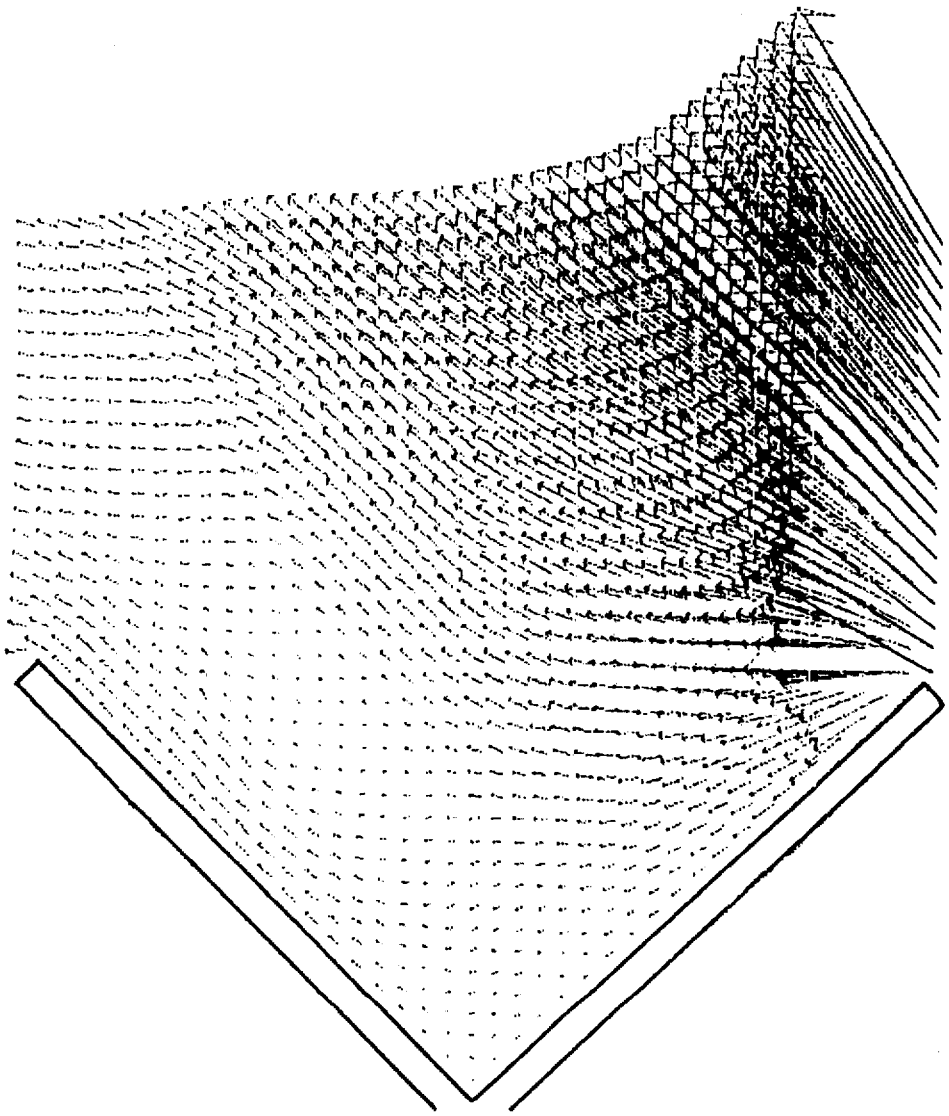
FIG. 8 (PRIOR ART)
FIG. 8 a graph showing how the acoustic intensity of a noise is distributed along the Y-shaped soundproof wall.

For a comparison of sound attenuation between the prior art and present invention, the soundproof walls shown in FIGS. 9, 13 and 14, respectively, we used as first to third test samples A, B and C, respectively. As a fourth comparison test sample D, a soundproof wall comprising no subordinate branch walls 4 and 5 but only a main wall 1 having a height of 2.5 m from the ground was used. In addition, we took the prior-art Y-shaped soundproof wall 102 shown in FIG. 3, was used as a fifth test sample E. The soundproof wall E was dimensioned to have the same sizes as dimensions a, b and d specified in FIG. 9.

Figure 15:
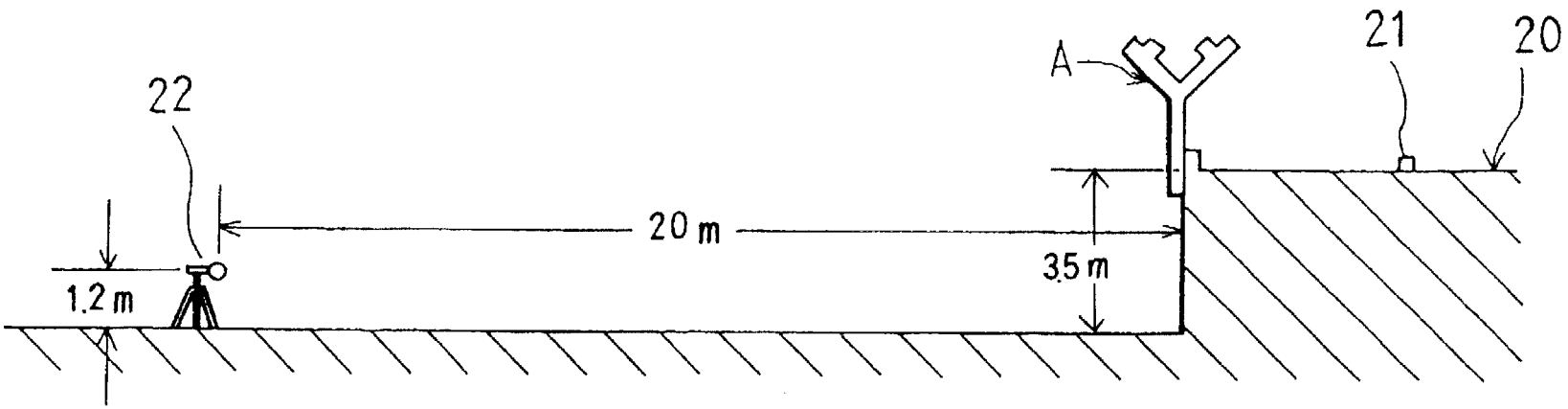
FIG. 15 explains how the effect of sound attenuation by the soundproof wall according to the present invention is measured.

Each of the soundproof wall samples A to E was formed to have a length of 100 m. As shown in FIG. 15, the walls were erected along a bank road 20 elevated to a height of 3.5 m from the surrounding ground surface. The soundproof wall was secured to the outer side face of the road 20. A speaker 21 was placed on the road 20 at a distance of 4.5 m from the soundproof wall. A microphone 22 was placed at a position 20 m away from the outer side face of the road 20 and 1.2 high from the ground surface. For noise level measurement, sounds in 250 Hz-, 500 Hz-, 1 kHz-, 2 kHz- and 4 kHz-octave bands were generated from the speaker 21.

The soundproof wall illustrated in FIG. 15 is the comparison test sample A which is shown in FIG. 9. The other test samples B to E were measured similarly to the sample A. Table 1 shows the sound attention (in decibels) by the soundproof wall samples against the sounds having the above-mentioned frequencies in comparison with those by the sample D.

TABLE 1

Measured sound attenuation increase (in dB)

| | D | E | A | B | C |
|---|---|---|---|---|---|
| 250 Hz | — | 1 | 2 | 6 | 5 |
| 500 Hz | — | 3 | 5 | 9 | 8 |
| 1 kHz | — | 4 | 6 | 10 | 9 |
| 2 kHz | — | 4 | 6 | 10 | 9 |
| 4 kHz | — | 4 | 6 | 10 | 9 |

As evident from Table 1, the soundproof wall having the first and second branch walls 2 and 3 (sample E) was more effective in sound attenuation than the one having only the main wall (sample D) and the sample A having the subordinate branch walls 4 and 5 showed a higher effect of sound attenuation than the sample E. However, Table 1 proves that the samples B and C having the sound absorbing member 10 attached thereon are much more effective in sound attenuation than the sample A having only the first and second branch walls 2 and subordinate branch walls 4 and 5 provided on the main wall 1. The difference in effect of sound attenuation between the samples B and C, both having the sound absorbing member 10, is no more than 1 dB. So the sample C may be said to be rather practical because it is producible at lower costs.

Figure 16:
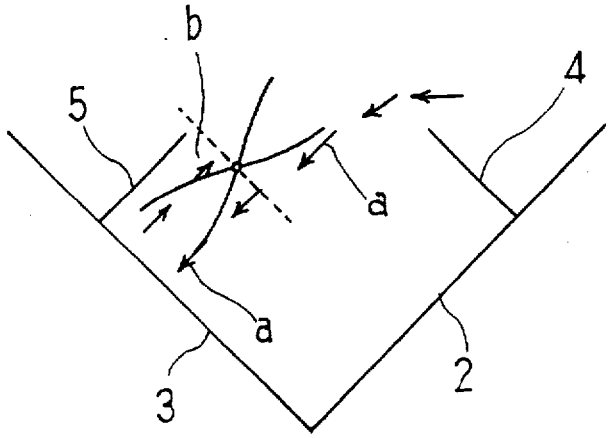
FIG. 16 shows schematically how the sound waves interfere with each other in the preferred embodiment in FIG. 9.
Figure 17:
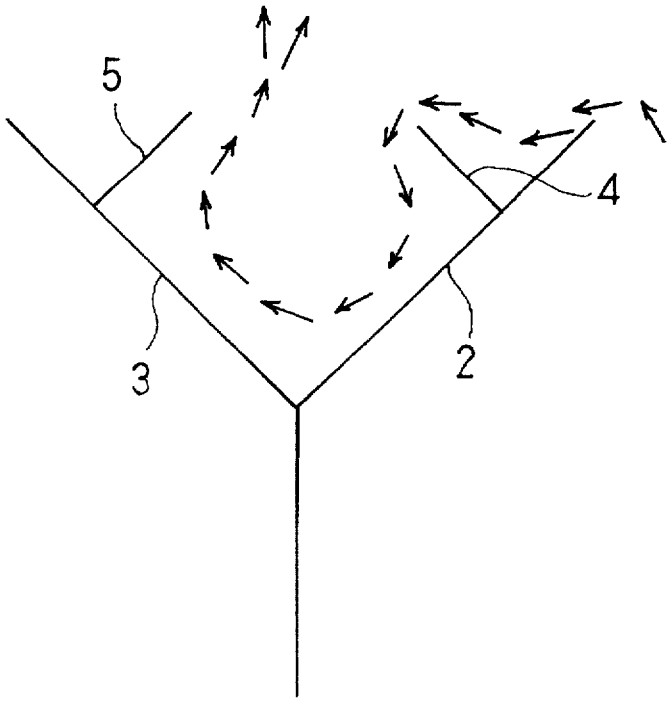
FIG. 17 shows schematically how to the sound waves make an eddy flow along the soundproof wall in FIG. 9.

Generally speaking, the lower the sound pressure level at a sound diffraction point, the weaker the diffracted sound wave is. Referring to FIG. 16, at the free end of the subordinate branch wall 3 extending from the second branch wall 5 of the sample A directed away from the sound source, a sound wave a coming from the source interferes with a sound wave b reflected by the second branch wall 3, resulting in an extreme reduction of the sound pressure level if the sound is at a certain frequency level. Thus, the final diffracted wave is highly attenuated. As shown in FIG. 17, the acoustic energy of a sound at a certain frequency level makes an eddy flow from the sound incident point to the sound source, resulting in an effective sound attenuation.

Figure 18:
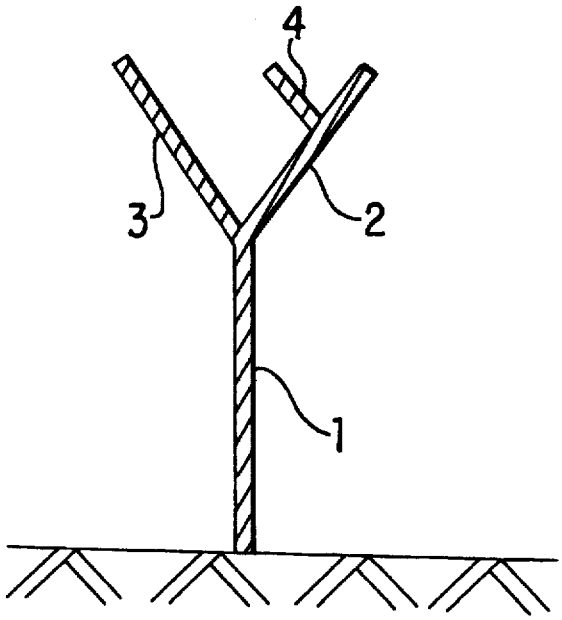
FIG. 18 is a sectional view of a second embodiment in which a subordinate branch wall is provided only on the first branch wall.
Figure 19:
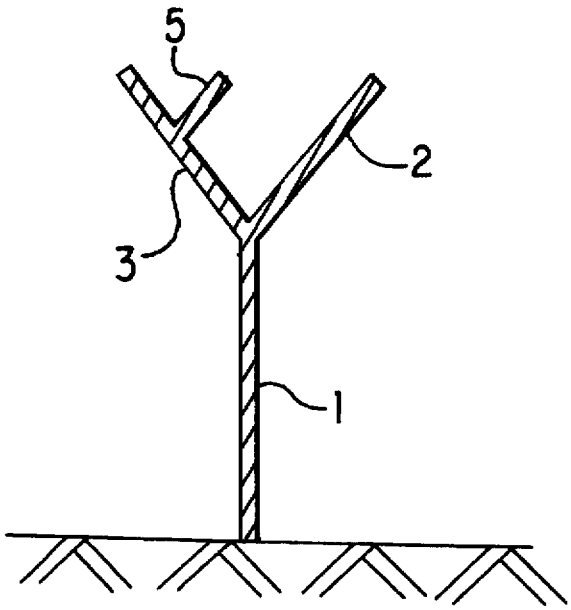
FIG. 19 is a sectional view of a third embodiment in which a subordinate branch wall is provided only on the second branch wall.

FIG. 18 shows a second embodiment of the present invention in which the subordinate branch wall 4 is provided only on the first branch wall 2, and FIG. 19 shows a third embodiment in which the subordinate branch wall 5 is provided on the second branch wall 3.

Figure 20:
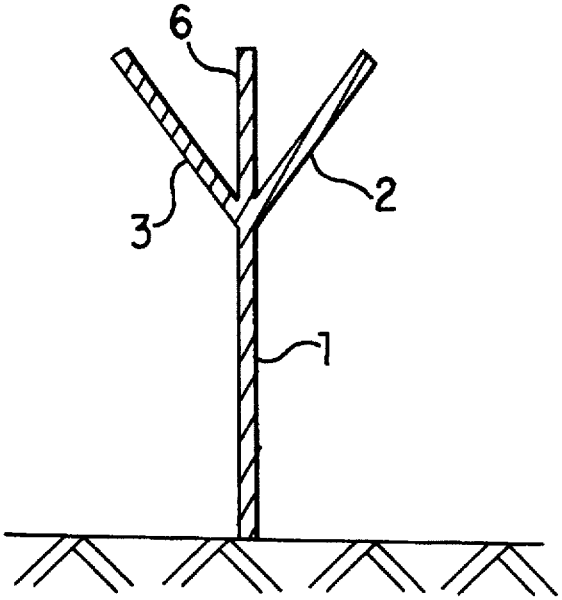
FIG. 20 is a sectional view of a fourth embodiment in which a third branch wall is provided without any subordinate branch wall.

According to a fourth embodiment illustrated in FIG. 20, the main wall 1 has provided atop thereof a third branch wall 6 rising vertically upward in addition to the first and second branch walls 2 and 3 as shown in FIG. 9.

Figure 21:
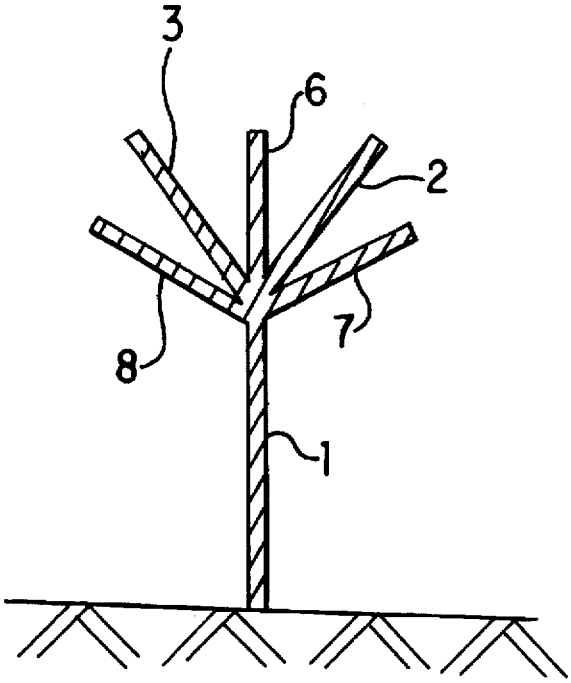
FIG. 21 is a sectional view of a fifth embodiment in which a plurality of third branch walls is provided.

FIG. 21 shows a fifth embodiment in which five branch walls are provided including three third branch walls 6, 7 and 8 provided in addition to the first and second branch walls 2 and 3.

In any of the aforementioned embodiments of the present invention, the sound absorbing member 10, made of a rock wool, glass wool, ceramic, foamed concrete or the like, should preferably be provided on the surface of the main wall 1 facing the sound source and both the inner and outer sides of the branch walls and subordinate branch walls. To drain rain, etc. of remove any dust such as dead leaves or the like, each of the base portions of the first and second branch walls 2 and 3 atop the main wall 1, those of the third branch walls 6 to 8 and those of the subordinate branch walls 4 and 5 optionally have a drain groove or hole or an opening which can be dosed. Such groove or hole or opening should be normally closed. Furthermore, it is desirable to cover with a protective net the top end of the main wall 1 on which the branch walls and subordinate branch walls are provided. The net prevents any contaminants such as dead leaves, thrown-away cans or other debris from collecting there.

Figure 22:
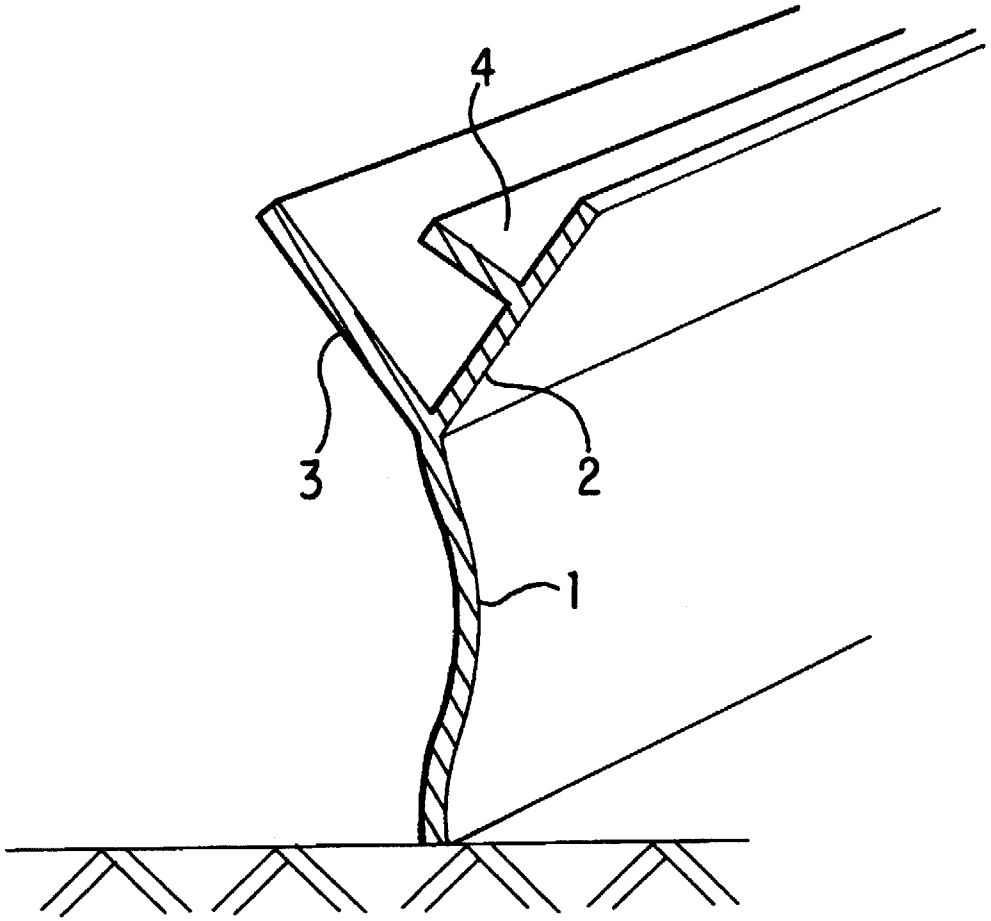
FIG. 22 is a sectional view of a sixth embodiment in which the main wall is curved at the middle portion thereof.

FIG. 22 shows a sixth embodiment in which the intermediate portion of the main wall 1 is curved toward or away from a sound source.

The top end of the main wall 1 is ramified into a plurality of branch walls 2, 3, . . . At least the branch walls 2 and 3 are inclined toward and away from a sound source, respectively. At least one of the branch walls 2 and 3 is provided thereon with a subordinate branch wall 4 or 5 which extends in a direction different from the branch wall 4 or 5 or with third branch walls 6 to 8 instead of the branch wall 4 or 5 reclined in different directions. Thus, the soundproof wall has a plurality of diffraction points, which can effectively attenuate the noise as compared to a plain soundproof wall. The inclination of the first and second branch walls 2 and 3 with respect to an extension line of the main wall 1 is 45° in the embodiments shown in FIGS. 9, 13 and 14, and 40° in the embodiments in FIG. 18 and subsequent drawings. The inclination should preferably be within a range of 20° to 70° for an enhanced effect of sound attenuation.

The sound wave reflected by the soundproof wall is directed upward in the case it has a straight side on the side of a sound source. However, the existence of the second branch wall 2 has an effect to prevent the reflected sound wave from being directed upward. Also the diffracted sound wave coming from the top end of the first branch wall 2 is shut off by the subordinate branch walls 4 and 5 second branch wall 3. Thus there is only an extremely attenuated sound on the opposite side of the soundproof wall to the sound source. The space between the two branch walls 2 and 3 should desirably be larger.

What is claimed is:

1. A soundproof wall, comprising:

a main wall rising from a ground surface;

a first branch wall provided atop the main wall and inclined toward a noise source;

a second branch wall provided atop the main wall and inclined away from the noise source; and a subordinate branch wall provided on at least one of the first and second branch walls at an intermediate position between a top end and a base end of said at least one branch wall and extending in a direction other than that of the branch wall.

2. A soundproof wall, comprising:

a main wall rising substantially vertically from a ground surface;

a first branch wall provided atop the main wall and inclined toward a noise source;

a second branch wall provided atop the main wall and inclined away from the noise source; and a subordinate branch wall provided on at least one of the first and second branch walls at an intermediate position between a top end and a base end of said at least one branch wall and inclined in a direction toward another one of the first and second branch walls.

3. The soundproof wall according to claim 1 further comprising a second subordinate branch wall provided on another one of the first and second branch walls at an intermediate position between a top end and a base end of said another one of said at least one branch wall and inclined in a direction toward said at least one of the first and second branch walls.

* * * * *

UNITED STATES PATENT AND TRADEMARK OFFICE

CERTIFICATE OF CORRECTION

PATENT NO. : 5,678,364
DATED : October 21, 1997
INVENTOR(S) : Hiroshi SHIMA et al.

It is certified that error appears in the above-indentified patent and that said Letters Patent is hereby corrected as shown below:

Add to [30] Foreign Application Priority Data, the following:

July 17, 1995 [JP] Japan ..... 7-202824

Signed and Sealed this

Twentieth Day of January, 1998

*Attest:*

*Attesting Officer*

BRUCE LEHMAN

*Commissioner of Patents and Trademarks*